US005173128A

United States Patent [19]

Komatsubara et al.

[11] Patent Number: 5,173,128

[45] Date of Patent: Dec. 22, 1992

[54] METHOD OF PRODUCING ORIENTED SILICON STEEL SHEET HAVING VERY HIGH MAGNETIC FLUX DENSITY

[75] Inventors: Michiro Komatsubara; Toshio Sadayori; Katsuo Iwamoto; Yasuyuki Hayakawa; Takahiro Kan, all of Chiba, Japan

[73] Assignee: Kawasaki Steel Corporation, Japan

[21] Appl. No.: 784,163

[22] Filed: Oct. 28, 1991

[30] Foreign Application Priority Data

Nov. 1, 1990 [JP] Japan ..... 2-293515

[51] Int. Cl.[5] ..... H01F 1/04

[52] U.S. Cl. ..... 148/111; 148/113

[58] Field of Search ..... 148/111, 113

[56] References Cited

U.S. PATENT DOCUMENTS 4,938,807 7/1990 Takahashi et al. ..... 148/111

5,049,205 9/1991 Takahashi et al. ..... 148/111

FOREIGN PATENT DOCUMENTS 0321695 6/1989 European Pat. Off. ..... 148/111

0339474 11/1989 European Pat. Off. ..... 148/111

*Primary Examiner*—John P. Sheehan

*Attorney, Agent, or Firm*—Austin R. Miller

[57] ABSTRACT

An oriented silicon steel sheet having a very high magnetic flux density is produced from an oriented silicon steel containing AlN as the main inhibitor and also containing Sb by a method adapted to prevent the loss of the inhibiting ability of the surface layer of the steel, and to improve cooling conditions in annealing before the final cold rolling. The steel is hot rolled, subjected to at least one time the combination of annealing and cold rolling wherein the final cold rolling is performed with a rolling reduction of about 80 to 95%, subjected to decarburization and primary recrystallization annealing, and subjected to, after coating an annealing separation agent, final finish annealing. Before annealing is performed before the final cold rolling, a nitriding promoter is applied to the surface of the steel sheet, and the partial-pressure ratio of $N_2$ in the atmosphere for that annealing is adjusted to a value of not less than about 20%. In this way, it is possible to stably produce an oriented silicon steel sheet that exhibits a high magnetic flux density even with a small sheet thickness.

10 Claims, 3 Drawing Sheets

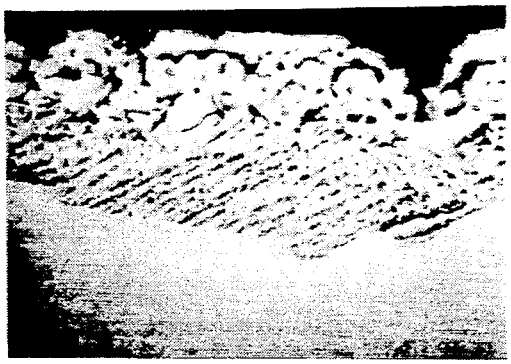
FIG. 3(a)
CONVENTIONAL

METHOD OF PRODUCING ORIENTED SILICON STEEL SHEET HAVING VERY HIGH MAGNETIC FLUX DENSITY

BACKGROUND OF THE INVENTION

1. Field of the Invention

The present invention relates to a method of producing an oriented silicon steel sheet having a very high magnetic flux density and, more particularly, to a novel way of effectively overcoming the loss of AlN in the surface layer of the steel.

It has been found that the AlN tends to be consumed during normalizing annealing or intermediate annealing, causing important disadvantages. The AlN loss serves to cause deterioration of the magnetic flux density which can be caused by a reduction in the thickness of the product sheet, and hence the AlN loss serves to deteriorate the desired high magnetic flux density in the steel regardless of the sheet thickness.

2. Description of the Related Art

Oriented silicon steel sheet is mainly used as an iron-core material for transformers, and is required to possess the magnetic characteristics of exhibiting high magnetic flux density and small core loss.

In recent years, advances in production technology have made it possible to produce, on an industrial scale, products possessing excellent magnetic characteristics of the above-described kind. For example, in the case of steel sheets having a sheet thickness of 0.23 mm, it has been made possible to produce products having a magnetic flux density $B_8$ (value at a magnetizing force of 800A/m) of 1.92T and an iron loss characteristic $W_{17/50}$ (value at the time of maximum magnetization at 50 Hz and 1.7T) of 0.90W/kg.

Materials having such excellent magnetic characteristics are comprised of a crystalline texture in which the <001> orientation, serving as the axis of easy magnetization, is highly aligned with the direction in which the steel sheet has been rolled. Such a texture is formed by a phenomenon known as secondary recrystallization during final finish annealing among the production processes of an oriented silicon steel sheet. In the secondary recrystallization, those crystal grains having the (110) [001] orientation are preferentially grown to a giant size. It is known that the fundamental requirements for sufficient growth of secondary recrystallized grains having the (110) [001] orientation are: (i) the existence of an inhibitor for restraining, in the process of secondary recrystallization, the growth of crystal grains having unpreferred orientations which are other than the (110) [001] orientation; and (ii) the formation of a primary recrystallization texture suitable for sufficient development of those secondary recrystallized grains having the (110) [001] orientation.

In general, fine precipitates of MnS, MnSe, AlN and the like are used as the inhibitor. Also, a method is known, in which, in addition to a precipitate (such as above), a grain boundary segregation type element (such as Sb or Sn) is used to strengthen the effect of the inhibitor.

Conventionally, a method in which MnS or MnSe is used as the main inhibitor has been regarded as advantageous for the purpose of reducing iron loss because the method achieves a small size of secondary recrystallized grains. Recently, however, it has become possible, by adopting such a method as a laser radiation method or a plasma jet method, to introduce artificial grain boundaries, and thus to form fine magnetic domains. As a result, the achievement of a small size of secondary recrystallized grains has become less regarded as advantageous than before and, instead, it has become more important to increase the magnetic flux density.

Methods for obtaining oriented silicon steel sheets having high magnetic flux densities have long been known. For example, it is known from Japanese patent publication No. 46-23820 that such a steel sheet can be produced by: (1) causing a steel to contain AlN as an inhibitor component; (2) effecting rapid cooling as cooling in the annealing before the final cold rolling, thereby allowing AlN to precipitate; and (3) employing a high rolling reduction of 80 to 95% in the final cold rolling.

However, the above known method has the disadvantage that, when the sheet thickness of the product is reduced, the magnetic flux density is greatly deteriorated. With this method, therefore, it has been very difficult to stably produce products which have a sheet thickness of not more than 0.25 mm and which have a $B_8$ value of not less than 1.94T, despite such products having recently been desired.

In view of the above-described circumstances, the present inventors have previously filed an application for the art described in Japanese patent laid-open No. 2-115319. This art is based on the finding that, if Sb is added to an oriented silicon steel including AlN as the main inhibitor, and, simultaneously, if the final finish annealing method is improved, it is possible to obtain a material having a very high magnetic flux density even when the steel sheet has a small finish sheet-thickness.

However, even with the method according to the present inventors' previous proposal, it has not always been easy to stably produce a material having a high magnetic flux density on an industrial scale.

It has been found that, if Sb is present, as described above, a problem arises in an industrial-scale production in that the secondary recrystallization does not take place. This makes it very difficult to stably obtain a material having a high magnetic flux density.

Specifically, the following case was often observed: even when a material obtained by processing a hot rolled steel sheet in a laboratory exhibited a very high magnetic flux density, a coil of the same material subjected to the same type of processing on an industrial scale failed to exhibit a high magnetic flux density, and also failed to undergo secondary recrystallization.

In order to determine the cause of the failure, the present inventors collected samples obtained from each of the processes, and examined the samples. As a result, the cause was determined on the basis of the fact that no precipitation of AlN, the main inhibitor, was detected in the surface layer portion of the steel sheet after, for instance, normalizing annealing and intermediate annealing. That is, it was discovered that dissipation of AlN caused the inhibiting ability of the steel sheet surface layer to be reduced, and thus permitted normal grain growth to take place in the final finish annealing, whereby secondary recrystallization failure occurred, and that the above phenomenon was the cause of failure in an industrial-scale production.

The phenomenon in which AlN in the surface layer of the steel sheet is consumed by normalizing annealing, intermediate annealing or a like process, occurs also with respect to steel containing no Sb. However, the phenomenon does not lead to any particularly serious consequence when the steel is the non-Sb type. We believe this is because, during final finish annealing, the renitriding of the steel sheet surface layer takes place before secondary recrystallization, whereby an AlN precipitate is again generated in the surface layer portion of the steel.

Specifically, during the final finish annealing (box annealing), the steel sheet being processed is exposed for a relatively long period of time to a nitrogen atmosphere in a stage prior to the start of the secondary recrystallization (within a temperature range below 900° C.). This exposure allows an excessive amount of Al contained in the steel to diffuse to the surface layer portion, and to combine with nitrogen diffusing from the surface of the steel sheet, thereby allowing AlN to reprecipitate. By virtue of the reprecipitation of AlN, the inhibiting ability of the surface layer of the steel sheet, which has been temporarily lost, is recovered in a timely manner before the start of the secondary recrystallization. For this reason, the phenomenon of AlN consumption has not been revealed.

However, in the case of steel containing Sb, the mechanism of recovering the inhibiting ability of the surface layer does not work. This is believed to be because Sb, which segregates on the steel sheet surface, acts to restrain nitriding, thereby making it very difficult for AlN, once consumed, to be reprecipitated and thus restored.

Regarding the art of strengthening the inhibiting ability of the surface layer of a steel sheet, Japanese patent publication No. 50-19489 discloses the art of employing nitrogen as an atmosphere during annealing of an oriented silicon steel containing Al, and nitriding the surface of the steel sheet, thereby precipitating AlN. This art has been tried by the present inventors. However, it was confirmed that, with respect to a steel sheet containing Sb, the nitriding was restrained by the above-discussed phenomenon, and it was difficult to improve the magnetic characteristics of the product.

SUMMARY OF THE INVENTION

The present inventors hereby provide art which is concerned with oriented silicon steel sheet containing AlN as the main inhibitor and also containing Sb, and which, while overcoming the above-described problems, is directed to preventing the loss of the inhibiting ability of the surface layer of the steel, and is also directed to improving cooling conditions in annealing before the final cold rolling, thereby making it possible to stably produce an oriented silicon steel sheet that exhibits a high magnetic flux density even with a small sheet thickness.

According to the present invention, there is provided a method of producing an oriented silicon steel sheet having a very high magnetic flux density by performing a series of steps comprising hot rolling an oriented silicon steel containing AlN as the main inhibitor and also containing Sb, effecting one time or a plurality of times the combination of annealing and cold rolling wherein the final cold rolling is performed with a rolling reduction of about 80 to 95%, effecting decarburization and primary recrystallization annealing, and, after coating an annealing separation agent, effecting finish annealing, the method including: before annealing is performed before the final cold rolling, applying a nitriding promoter to the surface of the steel sheet, and adjusting the partial-pressure ratio of $N_2$ in the atmosphere for that annealing to a value of not less than about 20%.

The above and other features of the present invention, as well as variations thereof, will be apparent from a reading of the following detailed description.

DETAILED DESCRIPTION OF THE INVENTION

In the present invention, AlN is used as the main inhibitor in order to achieve a high magnetic flux density, and preferably satisfies the ranges of about $0.01 \leqq$ acid soluble $Al \leqq 0.15\%$ by weight and $0.0030 \leqq N \leqq 0.020\%$ by weight.

Here, the main inhibitor means a substance without which the realization of secondary recrystallization will be impossible.

When AlN is thus used in the steel, S and/or Se may be contained as auxiliary inhibitor forming element(s).

S and Se, which respectively precipitate as MnS and MnSe, are effective as inhibitors. Between these precipitates, MnSe is particularly preferable because it provides a strong inhibiting effect even when the final finish sheet thickness is small.

The essential S and/or Se content is, in order to obtain fine precipitates of MnS and/or MnSe, within a preferable range which is approximately from 0.01 to 0.04% by weight in both of the cases where S or Se is used and where S and Se are used together. Mn is, as described above, an essential inhibitor component; however, the solution treatment becomes difficult if Mn is contained in an excessive amount. Therefore, the Mn content is preferably within the range from about 0.05 to 0.15% by weight.

In the present invention, it is also essential that Sb be contained in the steel. If about 0.005 to 0.08% by weight of Sb is contained, it is possible to obtain a product which has a very high magnetic flux density even when the steel sheet thickness is small. This is because the segregation of Sb on the steel sheet surface and in the grain boundaries effectively serves to maintain the inhibiting effect of the inhibitors even when the steel sheet thickness is small.

The present invention will now be specifically described on the basis of the results of certain experiments which are intended to be illustrative of the invention but not to limit its scope.

As described in the previous section, AlN in the surface layer portion of the steel sheet is consumed by normalizing annealing or intermediate annealing, thereby causing the inhibiting ability of the steel sheet surface layer to be lost. This is for the following reason: During such annealing, Al and N contained in the steel are oxidized on the surface of the steel by oxides in the steel sheet surface layer or by an oxidative atmosphere, and the oxidation causes a layer lacking in Al and N to be formed in the vicinity of the steel sheet surface, thereby resulting in the decomposition and dissipation of AlN. In order to restrain this phenomenon, therefore, it is possible to assume that nitriding of Al existing in the steel in an excessive amount is effective.

On this assumption, the present inventors first examined the influence of N in the atmosphere by conducting the following experiments.

Figure 1:
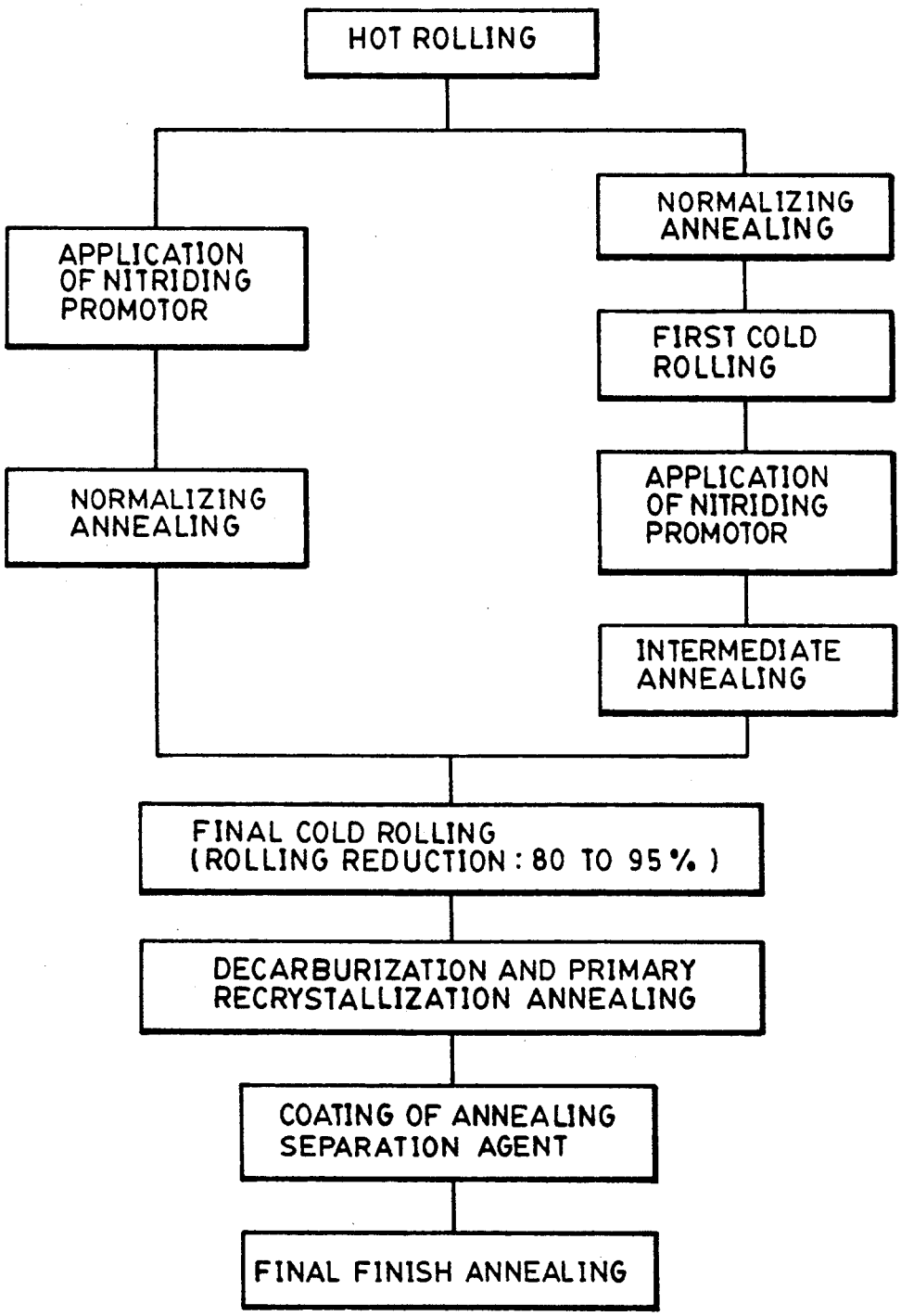
FIG. 1 is a diagram showing one form of production process according to the present invention.

A silicon steel, which had the chemical composition of C: 0.07 wt % ("wt %" will be abbreviated to "%"), Si: 3.3%, Mn: 0.08%, P: 0.005%, Se: 0.020%, Sb: 0.030% , Al: 0.025%, N: 0.0080%, and the balance substantially being Fe, was hot rolled by a common method to a thickness of 2.0 mm, and, thereafter, as shown in FIG. 1, subjected to normalizing annealing at 1000° C., cold rolled to a thickness of 1.5 mm, and annealed in $N_2$ at 1100° C. for 2 minutes. When the amount of N contained in the resultant steel was examined by analysis, the N content was found to be 75 ppm, a value indicating a reduction from the N content in the unprocessed steel. Subsequently, the present inventors examined the case where the flow rate of $N_2$ gas introduced to the furnace was increased. When 1 l/min of $N_2$ gas per 1 g of the sample was introduced, it was found that the N content in the steel after annealing increased to 79 ppm.

This method, however, requires a great amount of $N_2$ gas, and this feature renders the method very disadvantageous in respect of industrial application.

Accordingly, the present inventors tried other methods. As a result, it was found that a very small amount of CO gas contained in the exhaust gases hindered the nitriding of the steel. The mechanism by which the nitriding of the steel is hindered by a small amount of CO is not clear. However, it is believed that CO is generated as a result of C contained in the steel being oxidized similarly to the oxidation of Al or N. It was with a view to preventing the adverse influence of CO that, in the previous method, the gas flow rate was increased and the dissipation of CO was promoted. Furthermore, it was newly found that, for an unknown reason, it is effective to positively add certain gas components, such as $H_2O$, $CO_2$ and $O_2$, which increase the oxygen potential. In brief, it was found that the balance between CO and such components as $H_2O$, $CO_2$ and $O_2$ has a subtle influence on the nitriding of the steel.

Figure 2:
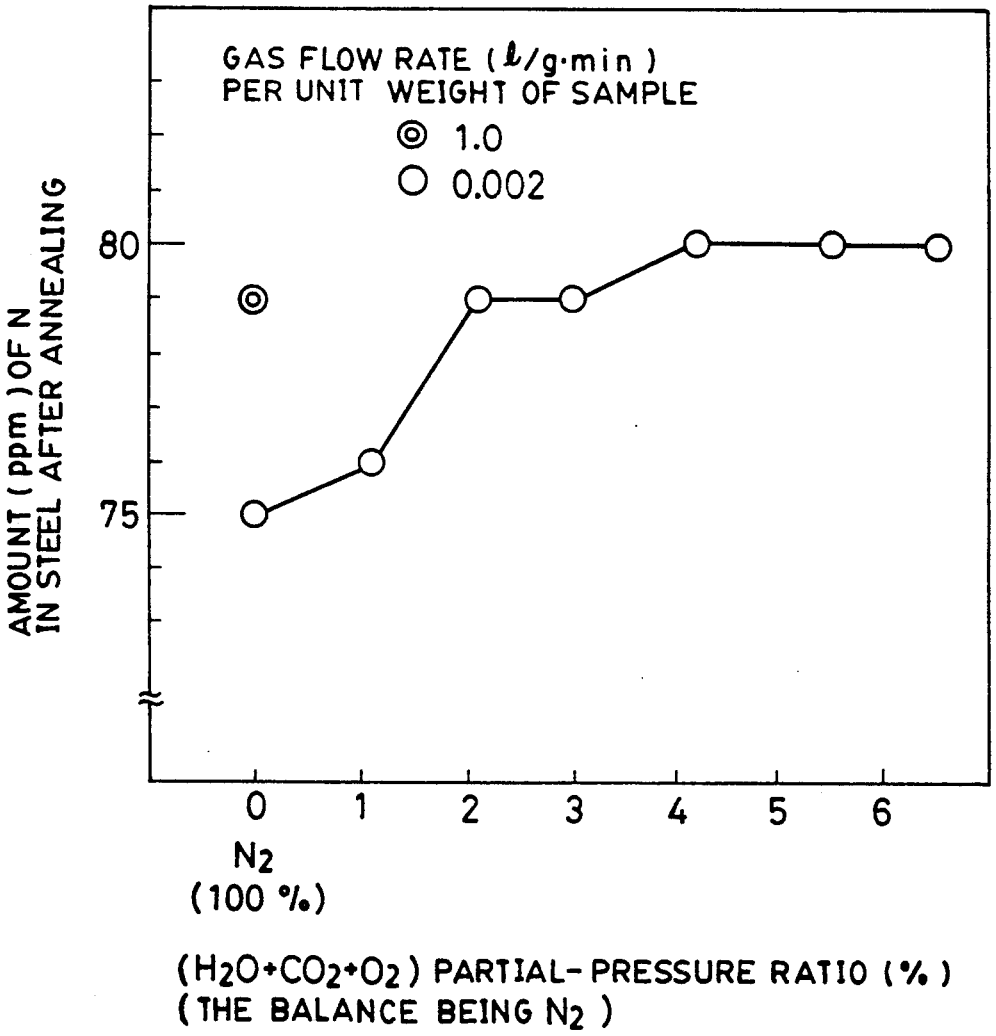
FIG. 2 is a graph showing the relationship between the total partial-pressure ratio of $H_2O$, $CO_2$ and $O_2$ in an annealing atmosphere and the amount of N in the steel after the annealing.

FIG. 2 shows the results of examining the amount of N in the steel after annealing by conducting experiments which were similar to those described above and in which the total partial-pressure ratio of $H_2O$, $CO_2$ and $O_2$ in the $N_2$ atmosphere were changed to various values.

It is understood from FIG. 2 that, if the total partial-pressure ratio of $H_2O$, $CO_2$ and $O_2$ is not less than about 2%, it is possible to achieve the same effects as those obtainable by increasing the $N_2$ gas flow rate.

On the basis of this knowledge, further experiments were performed by using actual coils and by introducing an atmosphere gas into an annealing furnace in a plant, the atmosphere gas containing 1.5% of $CO_2$, having a dew point of 25° C., and containing the balance of $N_2$ (wherein the total partial-pressure ratio of $CO_2$+-$H_2O$ was 4.6%). As a result, although some of the coils exhibited a very excellent magnetic characteristic of $B_8$=1.941T, most of the coils exhibited low levels of magnetic characteristic ranging from 1.76 to 1.86T, which were unsatisfactory.

In order to solve the problem, the present inventors conceived a concept totally different from the conventional conception, and conceived of promoting nitriding by coating a chemical agent on the surface of the steel sheet.

Such coating had never been tried. After testing various sample agents, the present inventors have found a group of chemical agents (described later) capable of promoting the nitriding of the steel sheet.

Specifically, the steel sheet having a thickness of 1.5 mm which had been cold rolled in the above-described method (but which had not been annealed yet) was divided into three parts to produce three steel-sheet samples. The first part was subjected to no coating, while the second and the third parts were respectively dipped in a 10%-$KNO_3$ aqueous solution and a 30%-$KNO_3$ aqueous solution, and then dried. All of the steel-sheet parts were annealed at 1100° C. for 2 minutes in an atmosphere containing 50% of $N_2$, having a dew point of 35° C., and containing the balance of $H_2$. When the amount of N in each of the steel samples after the annealing was measured by analysis, the first sample subjected to no coating contained 72 ppm of N after the annealing, and the second and third samples dipped in the $KNO_3$ aqueous solutions respectively contained 89 ppm and 96 ppm of N.

The steel-sheet samples were observed with a scanning electron microscope (SEM) employing a corrosion method. As a result, no precipitation of AlN was observed in the surface layer portion of the sample subjected to annealing without coating, shown in (FIG. 3 (*a*)) In contrast, fine precipitation of AlN was clearly observed in the steel sheet surface layer portion immediately below the subscales of the samples coated with $KNO_3$ which served as a nitriding promoter (FIGS. 3 (*b*) and 3 (*c*)).

The novel effect of coating with a nitriding promoter, as has been discovered by the present inventors, will be explained.

It is known that, in general, the existence of Sb in steel causes a great change in the form of oxide films (called "subscales") formed at the surface of the steel. Specifically, it is known that the existence of Sb causes the oxide films to be flat and dense. Since these films restrain C and N from diffusing, they generally hinder such action as decarburization, denitrification, carburization and nitrification.

Figure 3B:
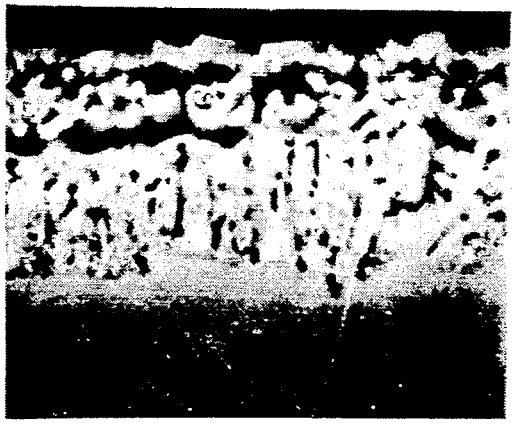
FIGS. 3 (*a*) to 3 (*c*) are microphotographs of metal structures, showing cross-sections of the surface layer of steel sheets after annealing, FIG. 3 (*a*) showing the case of an Sb-containing silicon steel processed by a conventional method, FIG. 3 (*b*) and 3 (*c*) showing the case of an Sb-containing silicon steel on which a nitriding promoter is coated according to the present invention.
Figure 3C:
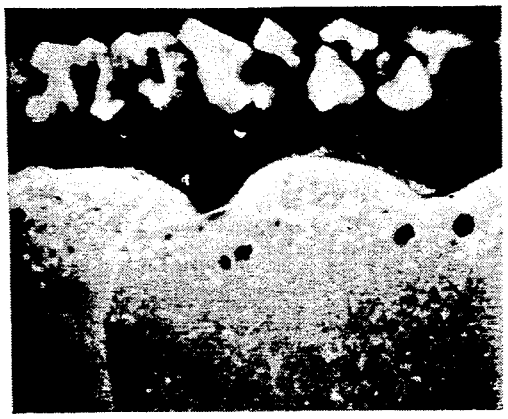

Referring to FIG. 3 (*a*), showing the case where no nitriding promoter was coated, it is understood that fine and dense subscales had developed. In contrast, in the case shown in FIG. 3 (*b*) and FIG. 3 (*c*), where a nitriding promoter according to this invention was applied to the steel sheet surface, the subscale layer was broken, and pipe-shaped voids (FIG. 3 (*b*)) or a relatively wide void layer (FIG. 3 (*c*)) was formed from the surface to the interface between the layer and the Fe base. It is believed that either the pipe-shaped voids or the void layer allows part of the atmosphere gas to pass therethrough and to directly contact the base Fe interface, thereby promoting nitriding.

In the case shown in FIGS. 3 (*b*) and 3 (*c*), numerous fine precipitates were observed on the base iron interface. It was confirmed, through electron microscopic analysis, that these precipitates were AlN. The above-described change of subscales caused by the application of a $KNO_3$ nitriding promoter to the steel sheet surface is attributable to changes of properties of silica which forms the subscales. When extracted samples were analyzed, it was found that, the coating of $KNO_3$ caused a solid solution of $K_2O$ in silica. It is believed from this fact that the tensile force on the silica surface changed, changing the configuration, thereby leading to the formation of voids or a void layer.

The $KNO_3$ has been found to be only one example of many substances that are effective nitriding promoters according to this invention. The present inventors have found substances such as the following to be effective as nitriding promoters: KCl, $KNO_3$, KF, KBr, $K_2CO_3$, $KHCO_3$, $MgCl_2$, $Mg(NO_3)_2$, $MgF_2$, $MgBr_2$, $MgCO_3$, $CaCl_2$, $Ca(NO_3)_2$, $CaF_2$, NaCl, $NaNO_3$, NaF, NaBr, $Na_2CO_3$, $NaHCO_3$.

A nitriding promoter can be effectively applied if applied in an amount ranging from about 0.5 to 30 $g/m^2$ per one surface of the steel sheet. An application amount less than about 0.5 $g/m^2$ is insufficient to achieve the effect of promoting nitriding. On the other hand, if the application amount exceeds about 30 $g/m^2$, properties of the steel sheet surface will be deteriorated. The method of applying a nitriding promoter may be any known method such as a roll coating method, a spray coating method or an electrostatic coating method. A chemical agent may be either directly applied while in the form of a powder or applied after dissolving the agent in a solvent, such as water, the latter application being followed by drying. Regarding the timing of the application, it is effective to coat a nitriding promoter at a stage prior to the annealing performed before the final cold rolling, as shown in FIG. 1. The effect of coating a nitriding promoter is the greatest if the application is performed immediately before the annealing. Although the application of a nitriding promoter may constitute an independent process, it is more advantageous to effect the application as a process linked with an annealing process before the final cold rolling process. That is, if cold rolling is to be performed only one time, a nitriding promoter is coated before normalizing annealing performed before the single cold rolling. If cold rolling is to be performed two times, since the second cold rolling is the final cold rolling, a nitriding promoter is preferably coated before intermediate annealing before the second cold rolling.

The atmosphere of the annealing performed before the final cold rolling is required to have an $N_2$ partial-pressure of not less than about 20%. This is because if the $N_2$ partial-pressure is less than about 20%, it is impossible to achieve sufficient nitriding despite the fact that a nitriding promoter has been coated on the steel surface, thereby involving the risk of deteriorating the magnetic flux density.

If certain atmosphere components of gases, such as $H_2O$, $CO_2$ and $O_2$, amounting to a partial-pressure not less than 2% in the atmosphere, which serve as sources for increasing the oxygen potential, are added to the annealing atmosphere, this is more advantageous in that the adverse effect of CO gas generated during the annealing is prevented.

Regarding the remaining gaseous component(s) of the annealing atmosphere, a reducing gas, such as $H_2$, and/or a neutral gas, such as Ar, may be included so as to balance the proportion of the atmosphere components. In this respect, an annealing atmosphere whose chemical composition is close to that of air, such as an atmosphere moistened with an ammonia decomposition gas ($N_2$=25%, $H_2$=75%) or an atmosphere containing a propane combustion gas, may be used, and sufficient nitriding effect will be obtained.

Although it is necessary that the composition of the gases of such an annealing atmosphere be maintained during the temperature increasing period and the soaking period, part of the composition may be replaced with other atmosphere gas(es) during the cooling period in which only a little nitriding action takes place.

As described above, if, before annealing is performed before the final cold rolling, a nitriding promoter is applied to the surface of the steel sheet and, simultaneously, if the atmosphere within the furnace is controlled, the problem caused by the AlN consumption can be overcome.

However, if, at the same time, the cooling conditions of the annealing before the final cold rolling are improved and the precipitation of carbides is controlled, further improvement of the magnetic flux density is possible.

The cooling conditions of the annealing before the final cold rolling will be described below.

It is possible to further improve the magnetic flux density by effecting certain cooling in the annealing before the final cold rolling, which cooling comprises effecting rapid cooling with a cooling speed of not less than about 15° C./sec and not more than about 500° C./sec until the achievement of a rapid-cooling target temperature of not more than about 450° C. and not less than about 200° C., and effecting either (a) holding the steel sheet at the rapid-cooling target temperature for a period of about 10 to 90 sec and thereafter, followed by rapid cooling or (b) gradual cooling for a period of about 10 to 90 sec with a cooling speed of not more than about 2° C./sec from the rapid-cooling target temperature, or conducting said treatment (a) or (b) being followed by controlling carbide precipitation.

If the rapid-cooling target temperature, among the above-stated cooling conditions, exceeds about 450° C., coarse precipitates of carbides are generated in the grain boundaries, thereby making it impossible to provide the effect of improving the primary recrystallization aggregate texture. On the other hand, if the temperature is less than about 200° C., this results in carbon being either transformed into the form of a solid solution or being precipitated as carbides having small sizes, thereby also making it impossible to provide the effect of improving the primary recrystallization texture.

If the cooling speed until the achievement of the rapid-cooling target temperature is less than about 15° C./sec, carbides start to precipitate at a relatively high temperature, thereby making it impossible to provide the effect of improving the primary recrystallization texture. If the cooling speed exceeds about 500° C./sec, it becomes difficult to control the rapid-cooling target temperature.

As stated above, the carbide precipitation treatment at the rapid-cooling target temperature may be performed either by maintaining the steel sheet at that temperature or by gradually cooling the steel sheet at a cooling speed of not more than about 2° C./sec. If this cooling temperature exceeds about 2° C./sec, it becomes difficult to control the size of carbide precipitates.

The period of the carbide precipitation treatment should preferably range from about 10 to 90 seconds. If this period is less than about 10 seconds, both the amount and the size of precipitates will be insufficient. If the period exceeds about 90 seconds, the precipitates will become coarse, thereby rendering insufficient the effect of improving the primary recrystallization texture.

It is preferable to adopt a method in which strain is induced in order to control the precipitation of carbides because, in this way, the ranges of temperature and period of time used to control the carbide precipitation can be enlarged.

In the case of strain induction, the temperature range of the carbide precipitation should be from about 500° to 200° C., and the precipitation period should be from about 10 to 180 seconds. If the temperature or the period is outside the above range, control over the size, the amount and the position of carbide precipitates will be insufficient, thereby failing to provide the effect of improving the primary recrystallization texture. It is believed that the reason why the manner in which carbides precipitate can be controlled by inducing strain is that the introduced dislocation provides nuclei at which carbides will precipitate. When strain is induced, therefore, the manner in which carbides precipitate becomes stable. A preferable amount of strain providing such advantage ranges from about 0.05 to 3%. If the amount of strain is less than about 0.05%, the strain will have only a little influence on the carbide precipitation. If the amount exceeds about 3%, the size of the resultant carbide precipitates will be too small. Either of these cases entails a reduction in the degree to which the primary recrystallization texture is improved.

Regarding the rolling reduction of the final cold rolling, it is necessary that a high rolling reduction be adopted in order to assure a high magnetic flux density. Therefore, the rolling reduction of the final cold rolling is specified as a value within the range from about 80 to 95% for both of the case where cold rolling is effected only one time and the case where cold rolling is effected two times. This is because, if the rolling reduction is less than about 80%, it is impossible to assure a high magnetic flux density, whereas if the rolling reduction exceeds about 95%, it becomes difficult for the secondary recrystallization to take place.

If aging treatment is effected in the course of the final cold rolling, this is advantageous in that the iron loss of the product will be reduced. Particularly with respect to the component system according to the present invention which includes Sb, the system has the excellent advantage that aging treatment, effected only one time and for a short period of time, enables a remarkable improvement in the magnetic flux density. The steel sheet resulting from the final cold rolling is, after subjected to degreasing, subjected to decarburization and primary recrystallization annealing.

Subsequently, an annealing separation agent (containing MgO as its main component) is coated on the surface of the steel sheet. The steel sheet is wound into a coil, and then subjected to the final finish annealing. Thereafter, an insulating coating is applied if necessary. Needless to say, in some cases, treatment for forming fine magnetic domains may be effected by a method employing a laser, plasma or the like.

EXAMPLE 1

Steel Sheet Samples (denoted by the symbols A to H in Table 1 and Table 2) were obtained by processing steels having the chemical compositions shown in Table 1 in the following manner. Each steel sheet was hot rolled by a normal method, thereby obtaining hot-rolled coils having a sheet thickness of 2.2 mm. Thereafter, the coils were subjected to normalizing annealing at 1000° C. for 90 seconds, and were then subjected to cold rolling, whereby an intermediate sheet thickness of 1.50 mm was achieved. Subsequently, a 15%-$NaHCO_3$ aqueous solution (serving as a nitriding promoter was spray-coated onto the surface of each coil in an amount sufficient to assure, after drying, an application amount per one surface of 5 g/m$^2$. Thereafter, each coil was subjected to intermediate annealing at 1100° C. for 90 seconds in an atmosphere containing 35% of $N_2$, having a dew point of 20° C., and containing the balance of $H_2$. Thereafter, each coil was rapidly cooled at a cooling speed of 45° C./sec to 400° C., then passed through a gradual cooling box equipped with a bending roll device, thereby gradually cooling each coil at a cooling speed of 2° C./sec to 250° C. while inducing 0.5% of strain, and then each coil was cooled in the air. Thereafter, each coil was cold rolled to a final sheet thickness of 0.22 mm. After the final cold rolling, each coil was subjected to electrolytic degreasing, which was followed by decarburization and primary recrystallization annealing at 850° C. for 2 minutes in moist hydrogen. Thereafter, each coil was coated with an MgO annealing separation agent (additionally containing 5% of $TiO_2$), and then subjected to final finish annealing at 1200° C. for 10 hours.

Thereafter, a tensile coating was applied on the surface of each coil. Subsequently, some of the coils were subjected to fine magnetic domain formation treatment at a pitch of 10 mm by a known plasma jet method.

Table 2 shows the results of examining the magnetic characteristics of the thus-obtained steel sheets before and after the fine magnetic domain formation treatment.

TABLE 1

| SAMPLE NO. | CHEMICAL COMPOSITION (%) | | | | | | | | | | | | | | | |
|---|---|---|---|---|---|---|---|---|---|---|---|---|---|---|---|---|
| | C | Si | Mn | P | Al | S | Se | Mo | Cu | Sb | Ge | Cr | Sn | Bi | B(ppm) | N(ppm) |
| A | 0.073 | 3.28 | 0.073 | 0.003 | 0.028 | 0.004 | 0.023 | tr | 0.01 | 0.024 | tr | 0.01 | 0.02 | 0.006 | 3 | 80 |
| B | 0.072 | 3.29 | 0.080 | 0.015 | 0.020 | 0.004 | tr | tr | 0.01 | 0.026 | tr | 0.01 | 0.02 | tr | 3 | 85 |
| C | 0.079 | 3.31 | 0.075 | 0.004 | 0.025 | 0.002 | 0.018 | tr | 0.02 | 0.029 | 0.008 | 0.01 | 0.02 | tr | 21 | 84 |
| D | 0.071 | 3.28 | 0.075 | 0.004 | 0.024 | 0.002 | 0.020 | tr | 0.02 | 0.008 | tr | 0.01 | 0.02 | tr | 3 | 80 |
| E | 0.070 | 3.25 | 0.077 | 0.002 | 0.022 | 0.002 | 0.019 | tr | 0.08 | 0.015 | tr | 0.01 | 0.02 | tr | 2 | 75 |
| F | 0.073 | 3.30 | 0.074 | 0.003 | 0.022 | 0.003 | 0.018 | tr | 0.02 | 0.035 | tr | 0.01 | 0.01 | tr | 3 | 83 |
| G | 0.065 | 3.28 | 0.069 | 0.003 | 0.021 | 0.004 | 0.020 | 0.010 | 0.02 | 0.025 | tr | 0.01 | 0.12 | tr | 3 | 84 |
| H | 0.069 | 3.34 | 0.081 | 0.003 | 0.021 | 0.014 | tr | tr | 0.02 | 0.027 | tr | 0.07 | 0.01 | tr | 4 | 85 |

TABLE 2

| SAMPLE NO. | BEFORE OR AFTER FINE DOMAIN FORMATION TREATMENT | MAGNETIC FLUX DENSITY $B_8$ (T) | IRON LOSS $W_{17/50}$ (W/kg) |
|---|---|---|---|
| A | BEFORE | 1.944 | 0.85 |
| | AFTER | 1.943 | 0.70 |
| B | BEFORE | 1.923 | 0.94 |
| | AFTER | 1.924 | 0.77 |
| C | BEFORE | 1.938 | 0.87 |
| | AFTER | 1.938 | 0.74 |
| D | BEFORE | 1.925 | 0.94 |

TABLE 2-continued

| SAMPLE NO. | BEFORE OR AFTER FINE DOMAIN FORMATION TREATMENT | MAGNETIC FLUX DENSITY $B_8$ (T) | IRON LOSS $W_{17/50}$ (W/kg) |
|---|---|---|---|
| | AFTER | 1.924 | 0.83 |
| E | BEFORE | 1.937 | 0.88 |
| | AFTER | 1.936 | 0.74 |
| F | BEFORE | 1.947 | 0.86 |
| | AFTER | 1.945 | 0.71 |
| G | BEFORE | 1.943 | 0.85 |
| | AFTER | 1.942 | 0.71 |
| H | BEFORE | 1.924 | 0.96 |
| | AFTER | 1.923 | 0.82 |

EXAMPLE 2

Steel sheets were obtained by processing the same steel as the Steel Sheet Sample F shown in Table 1 in the following manner. The steel was hot rolled by a normal method, thereby obtaining hot-rolled steel sheets having a thickness of 2.0 mm and a thickness of 1.5 mm. Thereafter, the sheets were subjected to normalizing annealing at 1000° C. for 90 seconds, and were then allowed to naturally dissipate heat. After effecting first cold rolling whereby the sheets were cold rolled to a thickness of 1.4 mm and 1.1 mm, respectively, each of the sheets was divided into first and second parts. While the first parts of each sheet remained uncoated, the second parts of each sheet were coated with 1.8 g/m$^2$ of $KNO_3$ (serving as a nitriding promoter) by dipping: each second part in a 20%-$KNO_3$ aqueous solution, and then: drying each part. Thereafter, both first and second parts of each sheet were subjected to intermediate annealing at 1100° C. for 90 seconds in an atmosphere containing 40% of $N_2$, having a dew point of 35° C., and containing the balance of $H_2$. In the intermediate annealing, the sheet parts were rapidly cooled at an average cooling speed of 60° C./sec to 350° C., then 1.0% of strain was induced by a hot leveler, and, after the sheet parts had been maintained at 310° C. for 120 seconds, they were taken out of the furnace, and subjected to natural dissipation of heat. Thereafter, the 1.4 mm-thick sheet parts were cold rolled to a final sheet thickness of 0.20 mm, and the 1.1 mm-thick sheet parts were cold rolled to a final sheet thickness of 0.15 mm. During this process, when the sheet parts respectively had the thickness of 0.70 mm and the thickness of 0.55 mm, the sheet parts were subjected to aging treatment at 300° C. for two minutes, and, thereafter, the final cold rolling was continued.

After the final cold rolling, each sheet part was subjected to degreasing, and then to decarburization and primary recrystallization annealing at 850° C. for 2 minutes. Thereafter, an MgO annealing separation agent (additionally containing 10% of $TiO_2$) was coated, and then, final finish annealing was effected at 1200° C. for 10 hours.

Thereafter, a tensile coating was applied to the surface of each sheet part, and then fine magnetic domain formation treatment was effected by radiating an electron beam at a pitch of 5 mm.

Table 3 shows the results of examining the magnetic characteristics of the sheet parts thus obtained.

TABLE 3

| FINAL THICKNESS(mm) | NITRIDING PROMOTER NOT COATED | | NITRIDING PROMOTER COATED | |
|---|---|---|---|---|
| | $B_8$ (T) | $W_{17/50}$ (W/kg) | $B_8$ (T) | $W_{17/50}$ (W/kg) |
| 0.20 | 1.905 | 0.86 | 1.937 | 0.80 |
| 0.15 | 1.893 | 0.80 | 1.926 | 0.72 |

EXAMPLE 3

Steel sheets were obtained by processing the same steel as the Sheet Sample G shown in Table 1 in the following manner. The steel was hot rolled by a normal method, thereby obtaining a hot-rolled coil having a thickness of 2.4 mm. Thereafter, the coil was divided into five parts (denoted as a, b, c, d and e in Table 4). After 3 g/m$^2$ of $K_2CO_3$ (serving as a nitriding promoter) was applied to each of the parts, the parts were annealed at 1175° C. for 90 seconds in different annealing atmospheres. Specifically, the part a was annealed in an atmosphere having an $N_2$ partial-pressure ratio of 10%; the part b in an atmosphere having an $N_2$ partial-pressure ratio of 23%; and the part c in an atmosphere having an $N_2$ partial-pressure ratio of 45%, whereas the part d was annealed in an atmosphere having an $N_2$ partial-pressure ratio of 75%, and the part e in an atmosphere having an $N_2$ partial-pressure ratio of 75%, a $CO_2$ partial-pressure ratio of 2%, and a dew point of 20° C. Each of the above atmospheres had its composition balanced by $H_2$.

In this annealing, cooling was effected in the following manner. Each part was rapidly cooled by dipping it in water at 80° C., and then cooled from 1175° C. to 80° C. in 25 seconds. Thereafter, the parts were cold rolled to a final sheet thickness of 0.30 mm. In the course of this process, when the parts had an intermediate thickness, they were subjected to aging treatment at 300° C. for 2 minutes. After the final cold rolling, each part was subjected to degreasing, and then to decarburization and primary recrystallization annealing at 850° C. for 2 minutes. Thereafter, an MgO annealing separation agent (additionally containing 2% of $SrSO_4$) was coated, and then, final finish annealing was effected at 1200° C. for 10 hours.

Thereafter, a tensile coating was applied to the surface of each part, and then magnetic characteristics of the parts were measured. Table 4 shows values obtained by this measurement.

TABLE 4

| ANNEALING ATMOSPHERE | $B_8$ (T) | $W_{17/50}$ (W/kg) | REFERENCE |
|---|---|---|---|
| a | 1.912 | 1.21 | COMPARISON EXAMPLE |
| b | 1.935 | 1.05 | EXAMPLE ACCORDING TO INVENTION |
| c | 1.942 | 1.03 | EXAMPLE ACCORDING TO INVENTION |
| d | 1.944 | 1.03 | EXAMPLE ACCORDING TO INVENTION |
| e | 1.948 | 0.98 | EXAMPLE ACCORDING TO INVENTION |

EXAMPLE 4

Steel sheets were obtained by processing the same steel as Sheet Sample F shown in Table 1 in the following manner. The steel was hot rolled by a normal method, thereby obtaining a hot-rolled coil having a thickness of 2.2 mm. Subsequently, the coil was subjected to normalizing annealing at 1000° C. for 90 seconds, and then to cold rolling, thereby obtaining an intermediate sheet thickness of 1.50 mm. Thereafter, a 15%-$K_2CO_3$ aqueous solution was applied by a spray in such a manner that the application amount per one surface of the coil was, after drying, 2.5 g/m$^2$.

Thereafter, the steel sheet was divided into first to third parts, and Coil a, Coil b, and Coil c (shown in Table 5) were obtained in the following manner. The first part was subjected to intermediate annealing at 1100° C. for 60 seconds in an atmosphere containing 60% of $N_2$, having a dew point of 35° C., and containing the balance of $H_2$. Thereafter, mist was sprayed on the first part to rapidly cool it at a speed of 40° C./sec to 330° C., then the part was gradually cooled at a cooling speed of 1.5 ° C./sec for 20 seconds, and dipped in water (Coil a).

The second part was subjected to intermediate annealing at 1100° C. for 60 seconds in an atmosphere containing 60% of $N_2$, having a dew point of 35° C., and containing the balance of $H_2$. Thereafter, mist was sprayed on the second part to rapidly cool it at a speed of 40° C./sec to 350° C., then the part was passed through a gradual cooling box having a bending roll device so that, while 0.3% of strain is induced, the part was gradually cooled at a cooling speed of 2 ° C./sec for 15 seconds. The part was then dipped in water (Coil b).

The third part was subjected to intermediate annealing at 1100° C. for 60 seconds in an atmosphere containing 60% of $N_2$, having a dew point of 35° C., and containing the balance of $H_2$. Thereafter, mist was sprayed on the third part to rapidly cool it at a speed of 35° C./sec to 80° C., and then the part was dipped in water (Coil C).

Thereafter, all of the three coils were each cold rolled to a final sheet thickness of 0.22 mm. The coils were then subjected to electrolytic degreasing, and then to decarburization and primary recrystallization annealing at 850° C. for 2 minutes. Thereafter, an MgO annealing separation agent (additionally containing 5% of $TiO_2$ and 3% of $Sr(OH)_2 \cdot 8H_2O$) was coated, and then, final finish annealing was effected at 1200° C. for 10 hours.

Thereafter, a tensile coating was applied to the surface of each part, and then magnetic characteristics of the coils were measured. Table 5 shows values obtained by this measurement.

TABLE 5

| SAMPLE | MAGNETIC CHARACTERISTICS | |
|---|---|---|
| | $B_8$ (T) | $W_{17/50}$ (W/kg) |
| COIL a | 1.946 | 0.85 |
| COIL b | 1.945 | 0.83 |
| COIL c | 1.934 | 0.89 |

Thus, according to the present invention, it is possible to stably obtain an oriented silicon steel sheet which assures a very high magnetic flux density regardless of the sheet thickness of the product.

What is claimed is:

1. A method of producing an oriented silicon steel sheet having a very high magnetic flux density by performing a series of steps comprising hot rolling an oriented silicon steel sheet containing AlN as the main inhibitor and also containing Sb, effecting one time or a plurality of times the combined steps of annealing and cold rolling including a final cold rolling with a rolling reduction of about 80 to 95%, decarburization and primary recrystallization annealing of the sheet, coating an annealing separation agent on the sheet and thereafter final finish annealing said sheet, further comprising:

before said annealing step prior to said final cold rolling step, applying a nitriding promoter to the surface of the steel sheet, and adjusting the partial pressure of $N_2$ in the atmosphere present in the annealing step prior to said final cold rolling step to a value of about 20% or more.

2. The method according to claim 1, further comprising adjusting the total partial pressures of $O_2$, $H_2O$ and $CO_2$ in the atmosphere of said annealing step before said final cold rolling step to a value of not less than about 2%.

3. A method according to claim 1, further comprising cooling said steel sheet in said annealing step before said final cold rolling step, said cooling comprising:

rapidly cooling said steel sheet with a cooling speed of not less than about 15° C./sec and not more than about 500° C./sec until the achievement of a rapid-cooling target temperature of not more than about 450° C. and not less than about 200° C.; and performing a further process selected from the group consisting of:

(a) holding said steel sheet at said rapid-cooling target temperature for a period of about 10 to 90 sec, followed by rapid cooling or (b) gradually cooling for a period of about 10 to 90 sec with a cooling speed of not more than 2° C./sec from said rapid-cooling target temperature.

4. A method according to claim 1, including effecting cooling of said steel sheet in said annealing step before said final cold rolling step, said cooling comprising:

rapidly cooling said steel sheet with a cooling speed of not less than about 15° C./sec and not more than about 500° C./sec until the achievement of a rapid-cooling target temperature of not more than about 500° C. and not less than about 200° C.; and applying a strain of not less than about 0.005% and not more than about 3.0% within a temperature range of from said rapid-cooling target temperature to about 200° C., while or after applying said strain performing a further process selected from the group consisting of: (a) holding said steel sheet within a temperature range of from said rapid-cooling temperature to about 200° C. for a period of about 10 to 180 sec or (b) gradually cooling with a cooling speed of not more than about 2° C./sec within a temperature range of from said rapid-cooling target temperature to about 200° C.

5. A method according to any of claims 1, 2, 3 and 4, wherein said nitriding promoter is selected from the group consisting of KCl, $KNO_3$, KF, KBr, $K_2CO_3$, $KHCO_3$, $MgCl_2$, $Mg(NO_3)_2$, $MgF_2$, $MgBr_2$, $MgCO_3$, $CaCl_2$, $Ca(NO_3)_2$, $CaF_2$, NaCl, $NaNO_3$, NaF, NaBr, $Na_2CO_3$, $NaHCO_3$.

6. A method according to any of claims 1, 2, 3 and 4, wherein said nitriding promoter is applied in an amount of about 0.5 to 30 g/m$^2$ per one surface of the steel sheet.

7. In a method of producing an oriented silicon steel sheet having a very high magnetic flux density regardless of the sheet thickness of the product, and wherein said silicon steel sheet contains AlN as the main inhibitor in an amount of about $0.01 \leqq$ acid soluble Al $\leqq 0.15\%$ by weight and $0.0030 \leqq N \leqq 0.020\%$ by weight, and further contains about 0.01–0.04% by weight of S or Se and about 0.05–0.15% by weight Mn, and also contains about 0.005–0.08% by weight Sb, and is subjected one time or a plurality of times to the combination of annealing and cold rolling, including final cold rolling, wherein said final cold rolling is performed with a rolling reduction of about 80 to 95%, and wherein said steel sheet is subjected to decarburization and primary recrystallization annealing, and wherein after coating with an annealing separation agent, said silicon steel sheet is subjected to final finish annealing, the steps which comprise:

(a) annealing said steel sheet containing Sb before said final cold rolling in an atmosphere having a partial pressure of $N_2$ of at least 20%, and (b) prior to annealing step (a), applying to the surface of said steel sheet a nitriding promoter effective to prevent continuous formation of oxide subscale layers and produce a multiplicity of fine precipitates of AlN at the surface of said steel sheet.

8. The method defined in claim 7 wherein said nitriding promoter is selected from the group consisting of KCl, $KNO_3$, KF, KBr, $K_2CO_3$, $KHCO_3$, $MgCl_2$, $Mg(NO_3)$, $MgBr_2$, $MgCO_3$, $CaCl_2$, $Ca(NO_3)_2$, $CaF_2$, $Na_2CO_3$, $NaHCO_3$ and is applied in an amount of about 0.5–30 $g/m^2$ of steel surface.

9. The method defined in claim 7 wherein said nitriding promoter is applied to said steel surface immediately before said annealing step which precedes final cold rolling.

10. The method defined in claim 7 including the further step (c) of providing a gaseous nitrogen atmosphere in the annealing step and controlling the partial pressure of said gaseous nitrogen to a value of about 20% or above.

* * * * *

UNITED STATES PATENT AND TRADEMARK OFFICE

CERTIFICATE OF CORRECTION

PATENT NO. : 5,173,128

DATED : December 22, 1992

INVENTOR(S) : Michiro Komatsubara et al

It is certified that error appears in the above-identified patent and that said Letters Patent is hereby corrected as shown below:

In column 16, line 6, after "$Mg(NO_3)$," please change to read as --$Mg(NO_3)_2$, $MgF_2$--; and after "$CaF_2$", please insert --NaCl, $NaNO_3$, NaF, NaBr,--.

Signed and Sealed this

Thirtieth Day of November, 1993

*Attest:*

*Attesting Officer*

BRUCE LEHMAN

*Commissioner of Patents and Trademarks*